United States Patent [19]

Lee

[11] Patent Number: 4,850,624

[45] Date of Patent: Jul. 25, 1989

[54] SUITCASE WITH A COUNTERCONDITIONING ACTION

[75] Inventor: Jung T. Lee, Taipei, Taiwan

[73] Assignee: Castip Industrial Co., Ltd., Taiwan

[21] Appl. No.: 141,086

[22] Filed: Jan. 5, 1988

[51] Int. Cl.[4] ..... E05C 3/04

[52] U.S. Cl. ..... 292/228; 292/207

[58] Field of Search ..... 292/228, 252, 150, 207; 70/70, 289

[56] References Cited

U.S. PATENT DOCUMENTS

| | | | |
|---|---|---|---|
| 2,429,494 | 10/1947 | Stephens | 70/289 X |
| 2,956,827 | 10/1960 | Humphries | 70/70 X |
| 3,591,219 | 7/1971 | Graziosi | 292/207 |
| 3,756,639 | 9/1973 | Wilkinson | 70/289 X |
| 4,214,783 | 7/1980 | Boegeman | 292/150 |

*Primary Examiner*—Richard E. Moore

*Attorney, Agent, or Firm*—Fleit, Jacobson, Cohn, Price, Holman & Stern

[57] ABSTRACT

A suitcase lock with a counterconditioning action is provided with a snap to open and close the suitcase through a push operation. A movable cotter is inserted into a hole on a support at the bottom surface of a push part of the snap. A cotter hole is provided to the upper edge plane of a base which corresponds in position to the cotter and is toward the upper cover of the suitcase. When the suitcase is placed in a normal state, there is a gap between the movable cotter and the upper edge planes of the base so as to not affect the push operation of the snap when used to open and close the suitcase. When the suitcase is placed upside down, the cotter is subject to the effect of gravity automatically inserts into the cotter hole on the upper edge plane of the base so that the snap cannot be pushed to open the suitcase.

3 Claims, 4 Drawing Sheets

SUITCASE WITH A COUNTERCONDITIONING ACTION

BACKGROUND OF THE INVENTION

1. Field of the Invention

The present invention is related to a suitcase. More specifically, the present invention is related to a suitacase lock with a counterconditioning action.

2. Description of the Background Art

Suitcases frequently have locks that can be opened regardless of the position of the suitcase. If the suitcase is in an upside down position, the contents of the suitcase can fall out of the suitcase and become scattered.

SUMMARY OF THE INVENTION

The present invention is related to a suitcase lock with a counterconditioning action which is characterized by the following structural design. The lock has a snap capable of swinging to-and-fro and which is pivotally jointed with a base. A support is at the bottom surface of a push part. A movable cotter is inserted into a hole on the support. A cotter hole is located on the upper edge plane of the base and corresponds to the location of the movable cotter so that, when the lock is installed on the lower body of the suitcase, the movable cotter is subject to the effect of gravity and moves between the upper and lower edge planes on the base. In this manner the lock will never unfavorably affect the push and swing operations of opening and closing between the snap and the upper cover catch of the suitcase when the suitcase is in an upright position. When the suitcase is placed upside down, namely, the lower body of suitcase is up but the upper cover thereof is down, the movable cotter is also subject to the effect of gravity and slides down to insert into the corresonding hole on the upper edge plane on the base. This positioning generates a counterconditioning action toward the snap which prevents it from being pushed to open the suitcase. This counterconditioning of the lock achieves the purpose of preventing the articles contained in the suitcase from dropping out when the suitcase is placed upside down.

DETAILED DESCRIPTION

Figure 1:
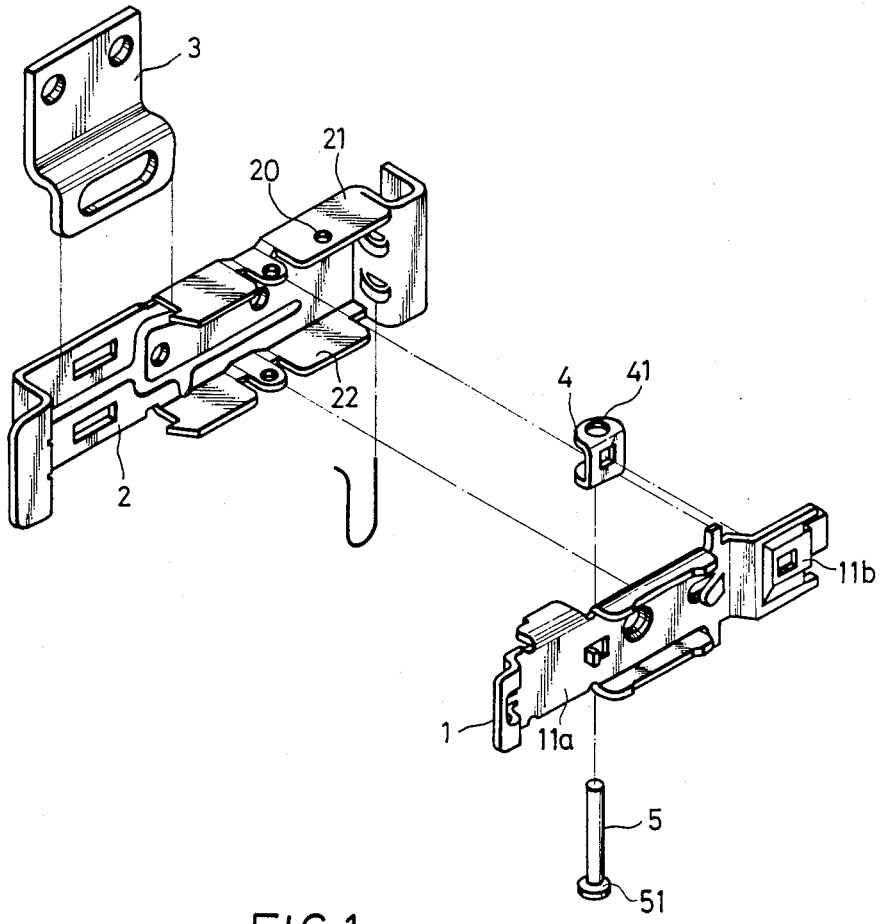
FIG. 1 is the preferred embodiment of an elevational breakdown of the present invention.

A suitcase lock according to the present invention has a counterconditioning action achieved by a movable cotter at a push part that is aligned with a cotter hole on the upper edge plane of a base. The cotter hole corresponds to the cotter under the effect of gravity such that, when the suitcase is placed upside down, the cotter will automatically insert into the cotter hole and prevent the snap from being pushed in order to open the suitcase. In this manner the articles contained in the suitcase are, therefore, prevented from dropping out.

So far as the conventional suitcase lock structure is concerned, the snap and base are installed on the lower body of the suitcase. A catch is set in the corresponding position on the upper cover thereof. Two locks are provided to a suitcase. The locks can be closed through the mutual insertion of the snap and catch and opened through pushing the snap to disengage it from the catch. Both the left and right locks on the suitcase may be simultaneously pushed to be opened or closed. However, the upper cover and lower body of suitcase are two structures with considerably similar configurations. The grip of a suitcase is always installed on the lower body, so the grip can be used to distinguish the lower body from the upper cover of the suitcase. Since the upper cover and the lower body are very similar to each other, a suitcase is frequently placed upside down before being opened. In this circumstance, the articles contained in the lower body of suitcase will inevitably drop out and become loose or scattered.

In view of the above drawback, and in order to eliminate such as inconvenience during use, the present inventor has improved the conventional suitcase lock structure to offer a directional lock structure for a suitcase which can be smoothly opened only when it is placed in a correct direction. this invention does not unfavorably affect the suitcase lock.

The primary object of the present invention is to offer a most desirably suitcase lock structure wherein a movable cotter is set on a support at the bottom surface of a push part of a snap on the lower body of a suitcase. A cotter hole is set in the snap edge plane of the base for locking the mechanism and a hole is set in the pivotal joint corresponding to the cotter. In this manner, when the suitcase is placed upside down, the movable cotter is subject to the effect of gravity to insert itself into the cotter hole such that the push part of the snap cannot be pushed to open the suitcase. Therefore, the suitcase has to placed in a correct direction or upright position such that the upper cover is up and the lower body is down. The movable cotter, which is subject to the effect of gravity, can automatically disengage from the cotter hole to open the suitcase. In this manner the suitcase lock set is directional. If the suitcase is placed upside down, it cannot be opened. Therefore, the drawback of conventional suitcase locks is removed.

An aspect of the present invention is the structural design of the suitcase lock. The length of movable cotter is kept with the distance between the upper and the lower edge planes of the base pivotally joined with the snap. Unless the cotter is inserted into the cotter hole on the upper edge plane, the cotter will not affect the normal push and swing operations of the snap. The lower end of the cotter around the lower edge plane of the base is a small annular body, the weight of which makes the counterconditioning effect of the cotter more subject to the effect of gravity. In other words, the cotter can slide and move more smoothly.

The structure and function of the present invention can be described in detail with reference to the accompanying drawings hereinafter described.

Figure 2:
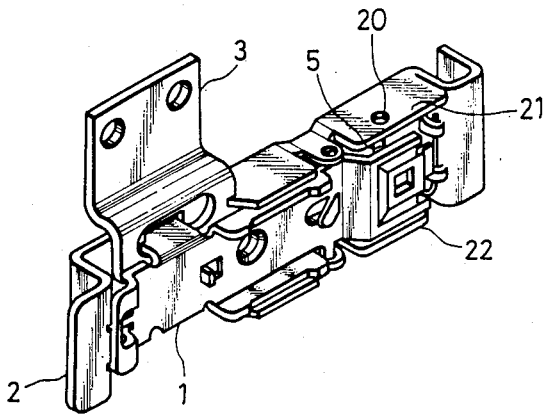
FIG. 2 is the preferred embodiment of elevational assembly view of the present invention.
Figure 3:
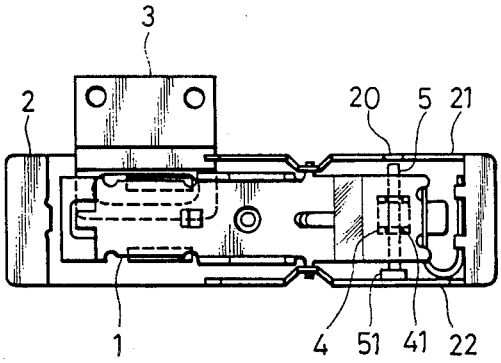
FIG. 3 is a front view of the present invention.
Figure 4:
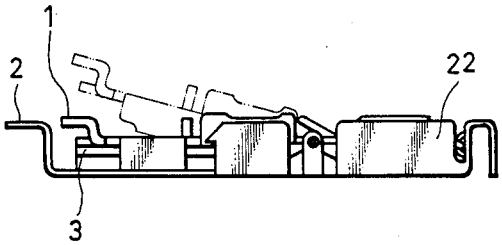
FIG. 4 is a side view of the present invention.

As shown in FIG. 1, the lock is composed of a snap 1, a base 2 and a catch 3. The snap 1 is pivotally jointed on the base 2 and can swing and be locked through pushing on the push part 11*a*. Both the snap 1 and base 2 are installed on the lower body 53 of the suitcase, but the catch 3 is installed on the upper cover 53 thereof. When the catch 3 extends into the base 2 after the closing of the suitcase, the snap 1 can lock with the catch 3 through a pushing and swinging movement assisted by a spring 54. The counterconditioning mechanism of the present invention is a support 4 on the bottom surface of push part 11*b* of the snap 1. A movable cotter 5 is inserted into a hole 41 thereon, and a cotter hole 20 is in a position on the upper edge plane 21 of base 2 which corresponds with the positioning of the movable cotter 5 as shown in FIG. 2. When the lock of the present invention is installed on a suitcase, a cotter hole 20 is provided to each upper edge plane 21 of base 2 of both the left and right locks toward the upper cover of suitcase. In other words, the operational movement of the cotter is directionally oriented. Since the length of said cotter 5 is kept or limited to be within the distance between the upper and lower edge planes 21 and 22 of the base 2, when the suitcase is placed in the correct direction, the small annular body 51 at the end of cotter 5 around the lower edge plane 22 of the base 2 is subjected to the effect of gravity. This disposes the cotter 5 between two edge planes 21 and 22 of the base 2 and nearer to the lower edge plane 22 as shown in FIG. 3. At this time, the length of cotter 5 is short enough that a gap exists between the cotter 5 and the upper edge plane 21. In this position pushing, swinging, and locking actions of the snap 1 are not affected. The cotter 5 is limited by the hole 41 on the support 4 and can align with and insert into the cotter hole 20 on the upper edge plane 21 as shown in FIG. 4. Therefore, under the normal operational condition with the upper cover of the suitcase being up and the lower body being down, the lock of the present invention can operate freely without any effect thereon from the cotter 5.

Figure 5:
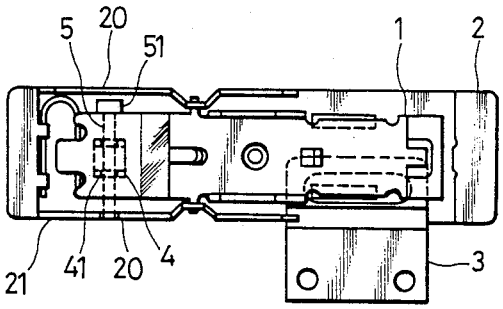
FIG. 5 is a front view of the present invention placed upside down.
Figure 6:
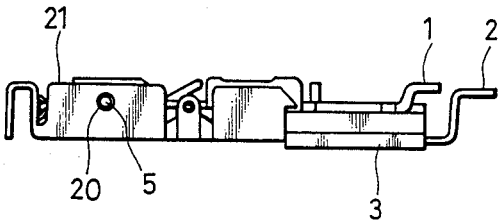
FIG. 6 is a side view of the present invention placed upside down.

If the suitcase is placed upside down, namely, the lower body of the suitcase is up, the cotter 5 is subject to the effect of gravity and slides. This displaces the cotter downwardly and inserts the cotter into hole 20 on the base 2 as shown in FIG. 5. In this position the push part 11b of snap 1 cannot be pushed because the cotter 5 is inserted into the cotter hole 20 as shown in FIG. 6. As a result of this displacement of the cotter 5, the snap 1 cannot be opened and the suitcase remains closed. Therefore, the lock may only be pushed to open the suitcase after movable cotter 5 is disengaged from the cotter hole 20. In other words, the suitcase, if placed upside down, has to be placed in its normal, upright condition as shown in FIG. 3 with the lower body of the suitcase down in order to be opened. The cotter 5, when the suitcase is uprighted, can be automatically disengaged from the cotter hole 20 through the effect gravity. So the lock of the present invention with a counterconditioning action can prevent the suitcase from opening under abnormal conditions (wherein the articles contained therein will inevitably drop out) and the suitcase can be kept in a good condition.

In summary, the present invention is a suitcase lock structure having a counterconditioning action which is novel, inventive, and practical. The invention can effectively prevent the suitcase, when mistakenly placed upside down, from being opened and permitting the articles contained therein from being dropped out of the structure.

I claim:

1. A suitcase lock having a counterconditioning action for preventing an upper body and a lower body of a suitcase from being opened when upside down, said suitcase lock comprising:

a base mounted to said lower body of a suitcase, said base having an upper edge plane and a lower edge plane, said upper edge plane having a cotter hole;

a locking snap and a catch, said snap being pivotally mounted to said base and adapted to removably engage said catch, said catch being mounted to said upper body of said suitcase;

a support mounted at a bottom surface of a push part of said snap, said support having at least one cotter hole;

a cotter, said cotter being of a length to engage said cotter hole having an annular body on an upper end, said cotter being slidably mounted through said cotter hole of said support whereby said cotter removably engages said cotter hole of said upper edge plane when said cotter is upside down.

2. The suitcase lock of claim 1 wherein said support has two cotter holes.

3. The suitcase lock of claim 1 wherein said annular body of said cotter rests upon (i) said lower edge plane when said suitcase is an upright position and (ii) said support when said suitcase is upside down.

* * * * *